US007860443B2

(12) United States Patent
Ahn et al.

(10) Patent No.: US 7,860,443 B2
(45) Date of Patent: Dec. 28, 2010

(54) FUSING DEVICE AND IMAGE FORMING APPARATUS USING THE SAME

(75) Inventors: Byung-sun Ahn, Suwon-si (KR); Kyung-shig Chung, Suwon-si (KR); Se-min Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 464 days.

(21) Appl. No.: 11/865,790

(22) Filed: Oct. 2, 2007

(65) Prior Publication Data

US 2008/0107459 A1 May 8, 2008

(30) Foreign Application Priority Data

Nov. 7, 2006 (KR) ..... 10-2006-0109410

(51) Int. Cl.
*G03G 15/20* (2006.01)

(52) U.S. Cl. ..... 399/329

(58) Field of Classification Search ..... 399/107, 399/122, 320, 328, 329; 219/216, 619
See application file for complete search history.

(56) References Cited

U.S. PATENT DOCUMENTS 5,052,547 A 10/1991 Doi
6,501,935 B2 * 12/2002 Hirai et al. ..... 399/329
6,975,829 B2 * 12/2005 Aruga ..... 399/329
7,016,638 B2 * 3/2006 Ono et al. ..... 399/329
2004/0033092 A1 2/2004 Aruga

FOREIGN PATENT DOCUMENTS

| | | |
|---|---|---|
| CN | 1467585 A | 1/2004 |
| JP | 10-307501 | 11/1998 |
| JP | 2004-151487 | 5/2004 |
| KR | 2001-0021120 | 3/2001 |
| KR | 2001-0061985 | 7/2001 |

OTHER PUBLICATIONS

Office Action issued Aug. 14, 2009 in corresponding Chinese Patent Application No. 200710161935.8.

* cited by examiner

*Primary Examiner*—Hoan Tran
(74) *Attorney, Agent, or Firm*—Staas & Halsey LLP

(57) ABSTRACT

A fusing unit provided in a printing path of an image forming apparatus to fuse an image transferred onto a printable medium, the fusing unit including a heat source; a heating roller of which a surface is heated by heat generated by the heat source; a plurality of pressing rollers which is provided opposite to the heating roller and presses a supplied printable medium in cooperation with the heating roller; a fusing pressing belt which is wound on the plurality of pressing rollers and forms a fusing nip contacting with the heating roller; and a supporting unit which rotatably supports the plurality of pressing rollers and guides the fusing pressing belt, a surface hardness $h_P$ of at least one of the plurality of pressing rollers is greater than or equal to a surface hardness $h_H$ of the heating roller.

20 Claims, 10 Drawing Sheets

FUSING DEVICE AND IMAGE FORMING APPARATUS USING THE SAME

CROSS-REFERENCE TO RELATED APPLICATIONS

This application claims from the benefit of Korean Patent Application No. 2006-109410, filed Nov. 7, 2006, in the Korean Intellectual Property Office, the disclosure of which is incorporated herein by reference.

BACKGROUND OF THE INVENTION

1. Field of the Invention

Aspects of the present invention relate to an image forming apparatus using a fusing unit to fuse an image transferred onto a printable medium and, more particularly, to a fusing unit and an image forming apparatus using the same that is of an endless belt type.

2. Related Art

An electrophotographic image forming apparatus, such as a laser printer, a photocopier, a facsimile machine, or a multi-functional product, forms an electrostatic latent image by scanning light onto a photosensitive medium that is charged to a predetermined electric potential, develops the electrostatic latent image by a toner of a predetermined color, and prints an image by transferring and fusing the developed image onto a printable medium. A fusing unit is provided in a printing path of the image forming apparatus to fuse the transferred toner image onto the printable medium.

Fusing units are generally classified into two types: a roller type and a belt type. In the roller type, the toner image transferred onto the printable medium is fused by a heating roller and a pressing roller placed opposite each other with the printable medium in between. In the belt type, a contact surface between the printable medium and the heating roller is expanded using an endless belt wound on two pressing rollers.

The belt type fusing unit has the contact surface between the printable medium and the pressing roller. The contact surface is larger than a fusing nip of the roller type fusing unit. Therefore, there is no need to increase the external diameter of the pressing roller in order to expand the width of the fusing nip, which is formed by the pressure exerted between the heating roller and the pressing roller. The overall constitution can thus be made compact. Since the contact surface of the belt type fusing unit is comparably larger than that of the roller type fusing unit, the superior fusing performance of the belt type reduces warming-up time and fusing when printing at high speed.

FIG. 1 is a schematic sectional view of a conventional endless belt type fusing unit. FIG. 2 is a perspective view partially showing the fusing unit of FIG. 1. Referring to FIG. 1 and FIG. 2, the conventional fusing unit fuses the toner image 15 formed on the printable medium 10. The conventional fusing unit comprises a heating roller 3 having a heating lamp 1 therein, a first and a second pressing rollers 5 and 7 placed opposite to the heating roller 3 and elastically biased toward the heating roller 3, and a fusing pressing belt 9 wound on the first and the second pressing rollers 5 and 7.

Heat generated by the heating lamp 1 is conducted to the heating roller 3, heating a surface of the heating roller 3. The surface temperature of the heating roller 3 is maintained at a predetermined temperature. The first and the second pressing rollers 5 and 7 rotatably support the fusing pressing belt 9 and cause the fusing pressing belt 9 to come into partial contact with the heating roller 3 or the supplied printable medium 10.

The first pressing roller 5 rotates and is elastically biased toward the heating roller 3 by an elastic member (not shown) to press the heating roller 3.

A width of the fusing pressing belt 9 is larger than a length of each of the first and the second pressing rollers 5 and 7 so that the heating roller 3 cannot come into direct contact with the first and the second pressing rollers 5 and 7. As shown in FIG. 2, an end part 9*b* of the fusing pressing belt 9 protrudes by a predetermined width in a lengthwise direction of the first and the second pressing rollers 5 and 7.

The hardness of the heating roller 3 is higher than that of the first pressing roller 5 so that a fusing nip $N_1$ can form between the heating roller 3 and the first pressing roller 5. Accordingly, if the first pressing roller 5 having a comparatively lower hardness contacts the heating roller 3 at a part 5*a*, the part 5*a* is deformed toward the center of the first pressing roller 5 by the pressure between the heating roller 3 and the first pressing roller 5. The shape of the fusing pressing belt 9 is deformed at the part 5*a* where the fusing nip $N_1$ of the first heating roller 5 is formed. As shown by a dotted line in FIG. 1, the fusing pressing belt 9, which is wound on the first and the second pressing rollers 5 and 7, becomes loose compared to a winding state of the fusing pressing belt 9 before the fusing nip $N_1$ is formed. As a result, both end parts 9*b* of the fusing pressing belt 9 protrude in the lengthwise direction of the first and the second pressing rollers 5 and 7. Of the end parts 9*b*, the part 9*c* where the fusing nip $N_1$ is located is wrinkled or folded, as shown in FIG. 2. Accordingly, the folded part 9*c* is damaged while continuously printing, thus reducing the lifetime of the fusing pressing belt.

If the fusing pressing belt 9 is employed as described in connection with FIG. 1 and FIG. 2, the fusing pressing belt 9 may slide in the lengthwise direction of the roller as the fusing pressing belt 9 rotates on the first and the second pressing rollers 5 and 7. The movement of the fusing pressing belt 9 in the width direction is called a belt bias. The belt bias may cause the fusing pressing belt 9 to come into contact with a guiding unit (not shown) provided at both sides of the fusing pressing belt 9 to guide the rotation of the fusing pressing belt 9 as well as to support the first and the second pressing rollers 5 and 7. The part of the fusing pressing belt 9 in contact with the guiding unit may be damaged by friction, thus reducing the lifetime of the fusing pressing belt 9.

SUMMARY OF THE INVENTION

Aspects of the present invention provide a fusing unit and an image forming apparatus using the same that prevents a fusing pressing belt from wrinkling or damage.

Another aspect of the present invention provides a fusing unit and an image forming apparatus using the same that can guide a belt bias of the fusing pressing belt in one direction and can provide a friction preventing structure in a direction of the belt bias of the fusing pressing belt so as to prevent damage to the fusing pressing belt.

According to an aspect of the present invention, there is provided a fusing unit disposed in a printing path of an image forming apparatus to fuse an image transferred onto a printable medium, the fusing unit comprising a heating roller; a plurality of pressing rollers provided opposite the heating roller to press a printable medium in cooperation with the heating roller; and a fusing pressing belt wound on the plurality of pressing rollers to form a fusing nip when in contact with the heating roller, the fusing nip fusing the image onto the printable medium; wherein a surface hardness $h_P$ of at least one of the plurality of pressing rollers is greater than or equal to a surface hardness $h_H$ of the heating roller.

According to another aspect of the invention, the plurality of pressing rollers comprise a first pressing roller and a second pressing roller; the first pressing roller is placed at an upstream position along a direction in which the printable medium advances; the second pressing roller is placed at a downstream position relative to the first pressing roller, and the surface hardness of the first pressing roller is greater than or equal to the surface hardness of the heating roller.

According to another aspect of the invention, the printable medium is supplied in a direction in which a surface of the printable medium, on which a toner image transferred but not yet fused is formed, faces the heating roller.

According to another aspect of the invention, a width of the fusing pressing belt is relatively larger than a length of the plurality of pressing rollers.

According to another aspect of the invention, the fusing unit further comprises a supporting unit rotatably supporting the plurality of pressing rollers to guide the fusing pressing belt. The supporting unit comprises a first supporting member comprising a first restriction unit to restrict a movement of the fusing pressing belt in an axial direction of the first or second pressing roller and a first contacting unit protruding from the first restriction unit toward the fusing pressing belt to contact with an inner plate surface of the fusing pressing belt; and a second supporting member comprising a second restriction unit to restrict the movement of the fusing pressing belt in the axial direction of the first or second pressing roller, and a second contacting unit protruding from the second restriction unit toward the fusing pressing belt to contact with the inner plate surface of the fusing pressing belt.

According to another aspect of the invention, the first contacting unit is formed to be inclined so that the shape of the first contacting unit becomes smaller gradually from the first restriction unit as far as the protruded end, and the second contacting unit is formed so that a surface of the second contacting unit contacting the fusing pressing belt is perpendicular to a restriction surface of the first restriction unit.

According to another aspect of the invention, an inclination angle of the first contacting unit is more than 0° and equal to or less than 10°.

According to another aspect of the invention, the fusing nip formed between the heating roller and the fusing pressing belt has a shape of the pressing roller or a straight line.

According to another aspect of the invention, a major diameter $D_1$ of the first contacting unit is greater than a major diameter $D_2$ of the second contacting unit, so that the fusing pressing belt biases toward the first supporting member while the fusing pressing belt is rotating.

According to another aspect of the invention, the fusing unit further comprises a wearing prevention plate, inserted in the first contacting unit and provided between the first restriction unit and the fusing pressing belt, to guide the rotation of the fusing pressing belt and to prevent wearing.

According to another aspect of the invention, the wearing prevention plate comprises a conductive material.

According to another aspect of the present invention an image forming apparatus is provided comprising: a developing unit to develop a supplied toner to form an image; a light scanning apparatus to scan a light onto the developing unit to form an electrostatic latent image; a transfer unit provided opposite the developing unit to transfer the image formed by the developing unit onto a printable medium; and a fusing unit to fuse a toner image transferred onto the printable medium.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE EMBODIMENTS

Figure 1:
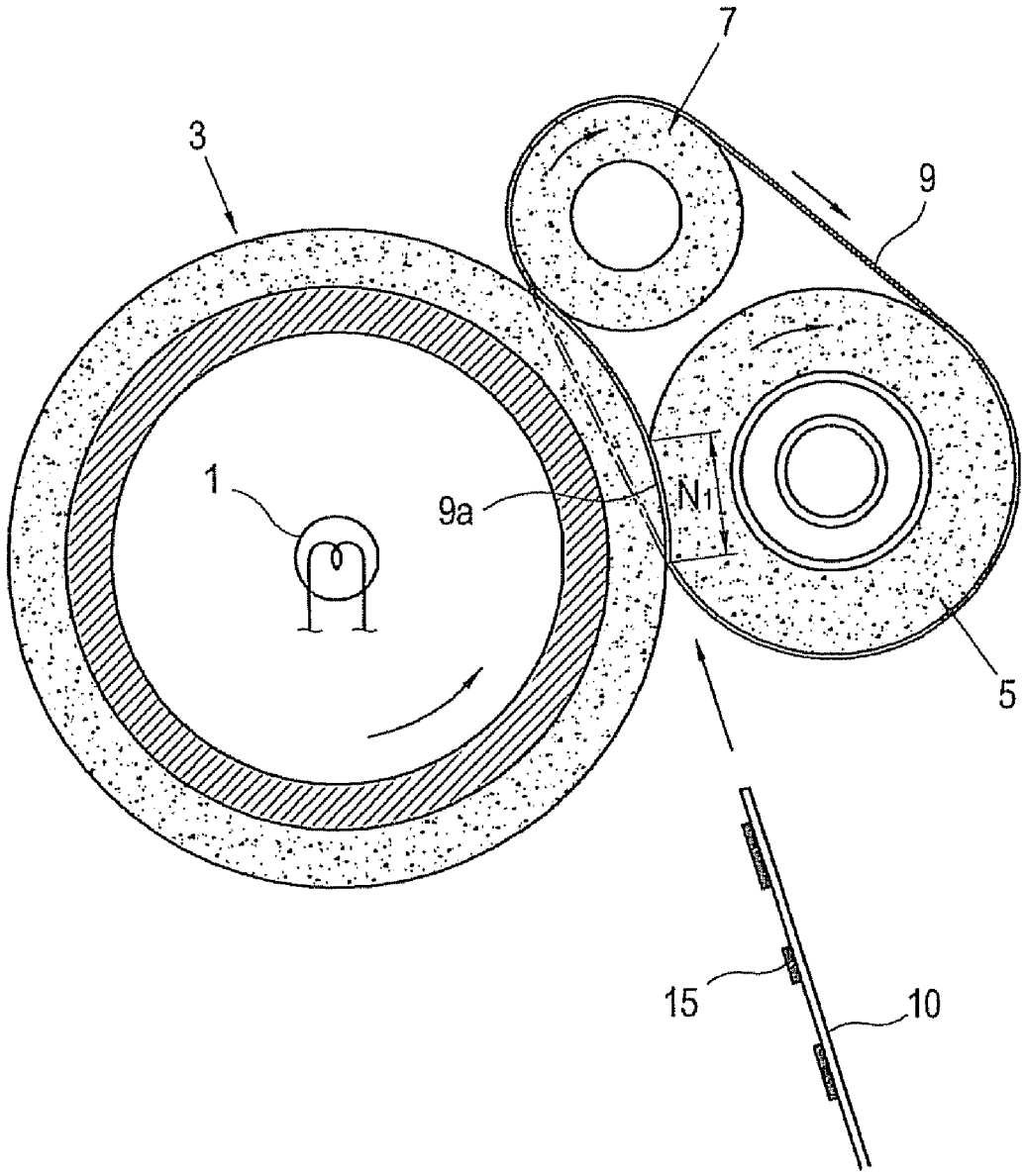
FIG. 1 (RELATED ART)
FIG. 1 is a schematic sectional view showing a conventional fusing unit.
Figure 2:
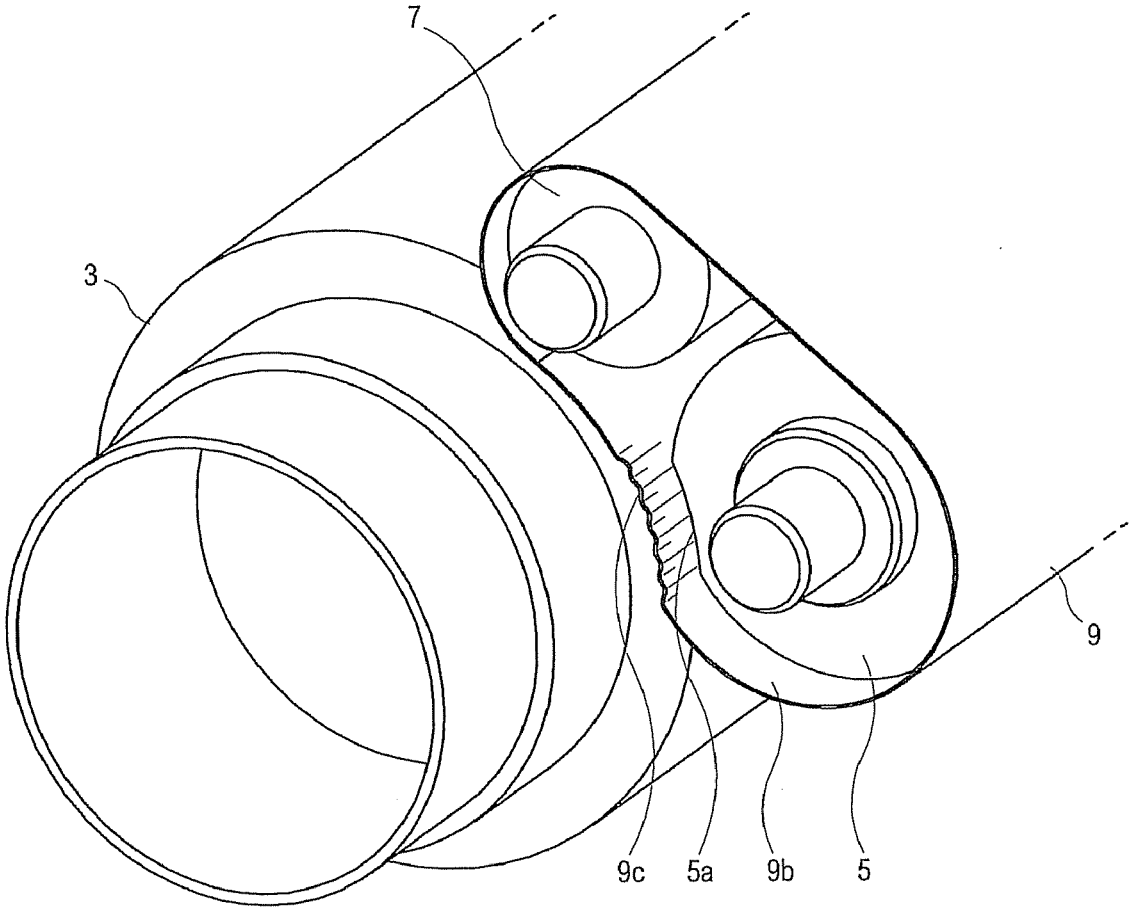
FIG. 2 (RELATED ART)
FIG. 2 is a perspective view partially showing the conventional fusing unit.

Reference will now be made in detail to the present embodiments of the present invention, examples of which are illustrated in the accompanying drawings, wherein like reference numerals refer to like elements throughout. The embodiments are described below in order to explain the present invention by referring to the figures.

Figure 3A:
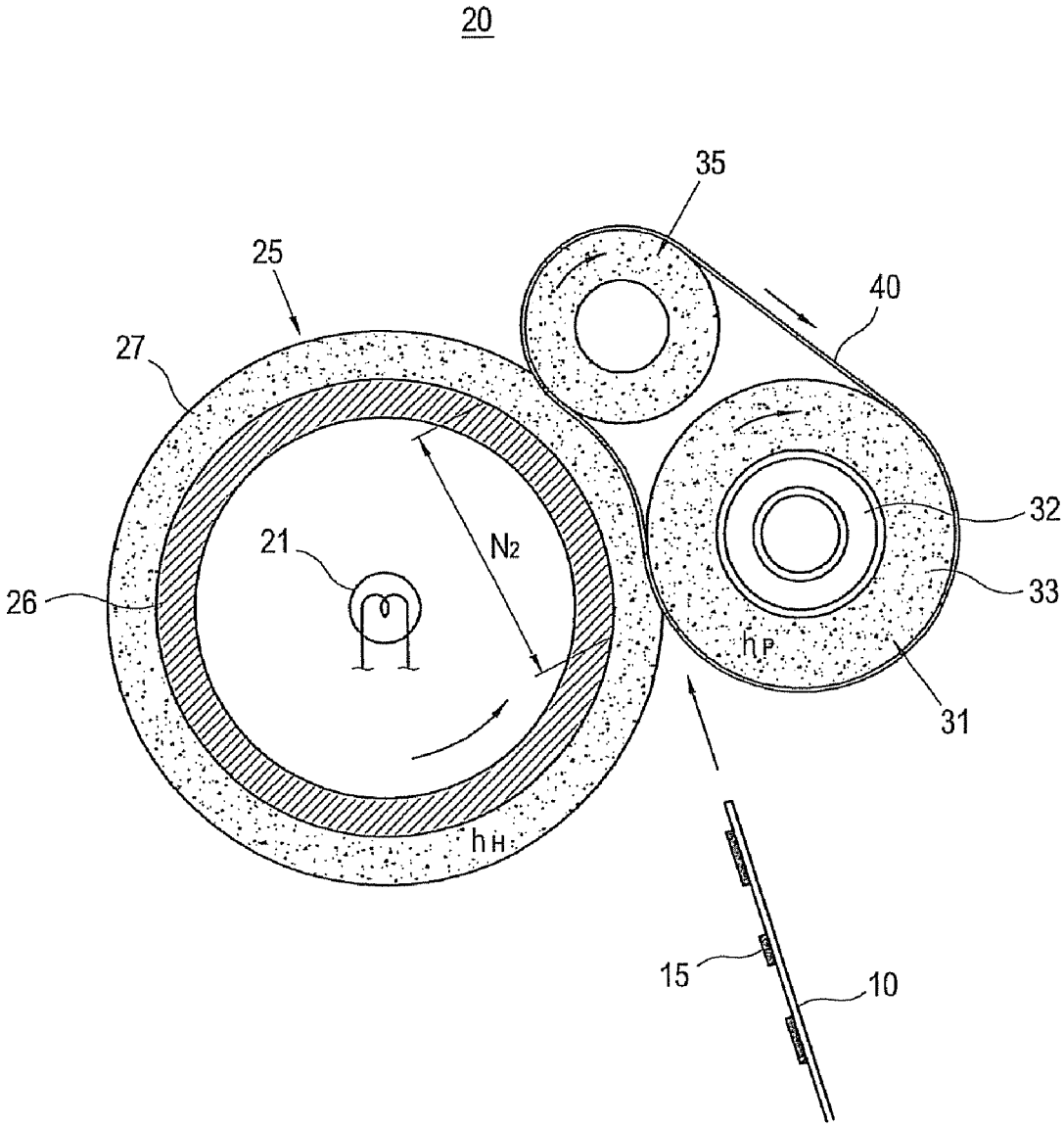
FIG. 3A is a schematic sectional view showing a fusing unit according to an example embodiment of the present invention.
Figure 3B:
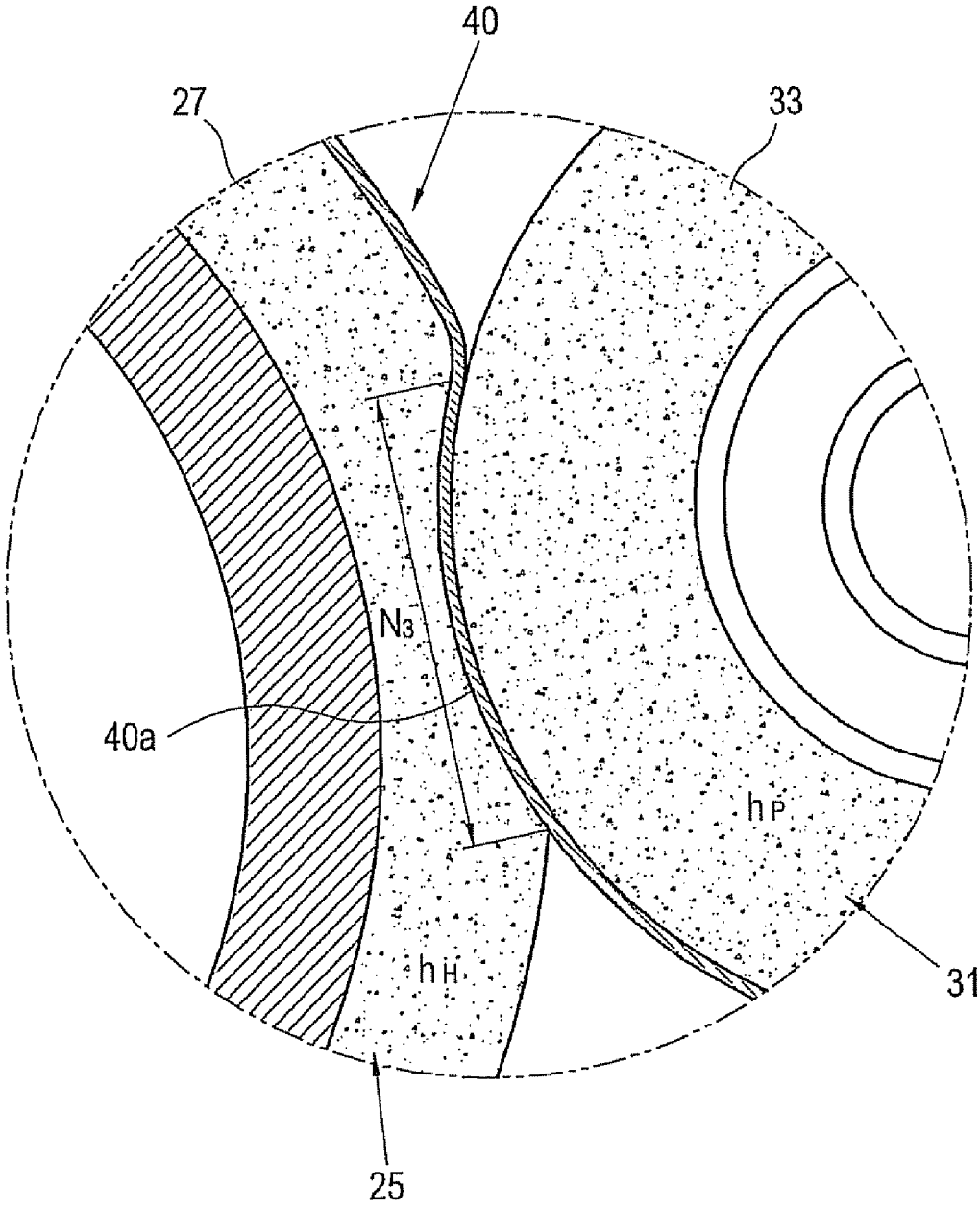
FIG. 3B is an expanded schematic sectional view partially showing the fusing unit in FIG. 3A.
Figure 4:
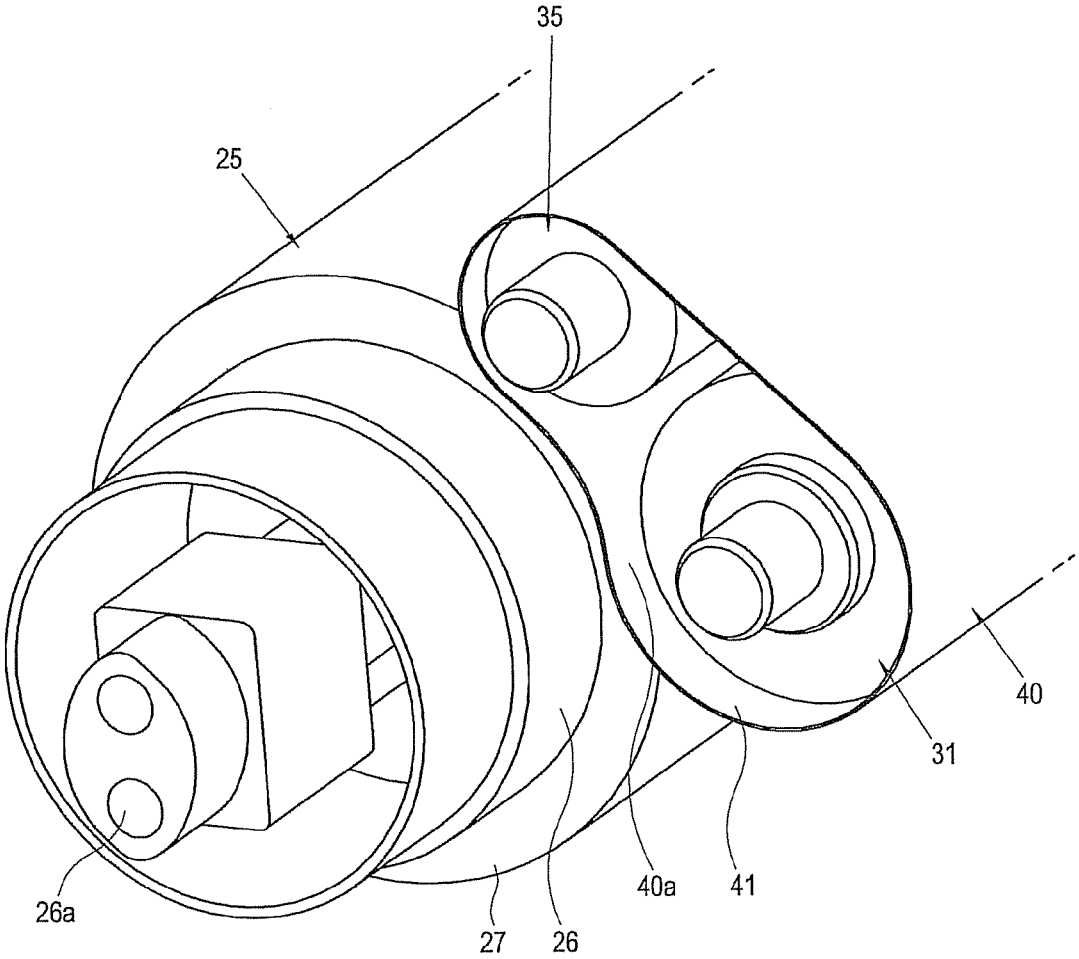
FIG. 4 is a perspective view partially showing the fusing unit according to an example embodiment of the present invention.

As shown in FIG. 3A, FIG. 3B, and FIG. 4, a fusing unit 20 according to an example embodiment of the present invention is provided in a printing path of an image forming apparatus to fuse a toner image 15 transferred onto a printable medium 10. The fusing unit 20 comprises a heat source 21, a heating roller 25 whose surface is heated by the heat source 21, a plurality of pressing rollers 31 and 35, a fusing pressing belt 40 wound on the pressing rollers 31 and 35, and a supporting unit 50 (shown in FIG. 5) rotatably supporting the pressing rollers 31 and 35. The printable medium 10 may be any medium capable of receiving an image, such as paper or transparent film.

The heat source 21 may comprise a halogen lamp, resistance heating coil or other type of heat source. Especially, if the heat source 21 comprises the halogen lamp, the heat source 21 is provided at a hollow part 26*a* of the heating roller 25. The heating roller 25 comprises a core 26 functioning as a rotation supporting shaft and a heating unit 27 provided at a circumference of the core 26 having a predetermined thickness. The core 26 is heated by the heat source 23 and an outer surface of the heating unit 27 is heated by conduction to maintain a predetermined fusing temperature.

The plurality of pressing rollers 31 and 35 are placed opposite the heating roller 25 and press the supplied printable medium 10 in cooperation with the heating roller 25. The plurality of pressing rollers 31 and 35 are elastically biased toward the heating roller 25 by an elastic member (not shown), forming a predetermined fusing nip $N_2$ in a contacting part between the fusing pressing belt 40 and the heating roller 25.

If a surface hardness of the heating roller 25, that is, a surface hardness of the heating unit 27, is $h_H$ and a surface hardness of at least one of the plurality of the pressing rollers 31 and 35 is $h_P$, the hardness $h_H$ and the hardness $h_P$ should satisfy the condition of Equation 1.

$$h_P \geqq h_H \quad \text{(Equation 1)}$$

The nip $N_2$ formed between the heating roller 25 and the fusing pressing belt 40 has a shape of the pressing roller 31 or a shape of a straight line. According to an example embodiment of the present invention, the surface hardness $h_P$ of the pressing rollers 31 and 35 is higher than the surface hardness $h_H$ of the heating unit 27.

The plurality of the pressing rollers may comprise first and second pressing rollers 31 and 35. The first pressing roller 31 is placed at an upstream position along a direction in which the supplied printable medium 10 advances and the second pressing roller 35 is placed at a downstream position relative to the first pressing roller 31. The first pressing roller 31 comprises a shaft 32 rotatably supported by the supporting unit 50 and a pressing unit 33 formed on the shaft 32 with a predetermined thickness.

The surface hardness of the first pressing roller 31, that is, the hardness of the pressing unit 33, satisfies Equation 1. If $h_P$ is higher than $h_H$, the shape of the fusing nip $N_3$ which is formed by the pressure between the heating roller 25 and the first pressing roller 31 can be described as follows. The shape of the pressing unit 33 is maintained by the difference in the hardness between the heating unit 27 and the pressing unit 33. The shape of the heating unit 27, which has a comparably low hardness, is deformed.

Figure 5:
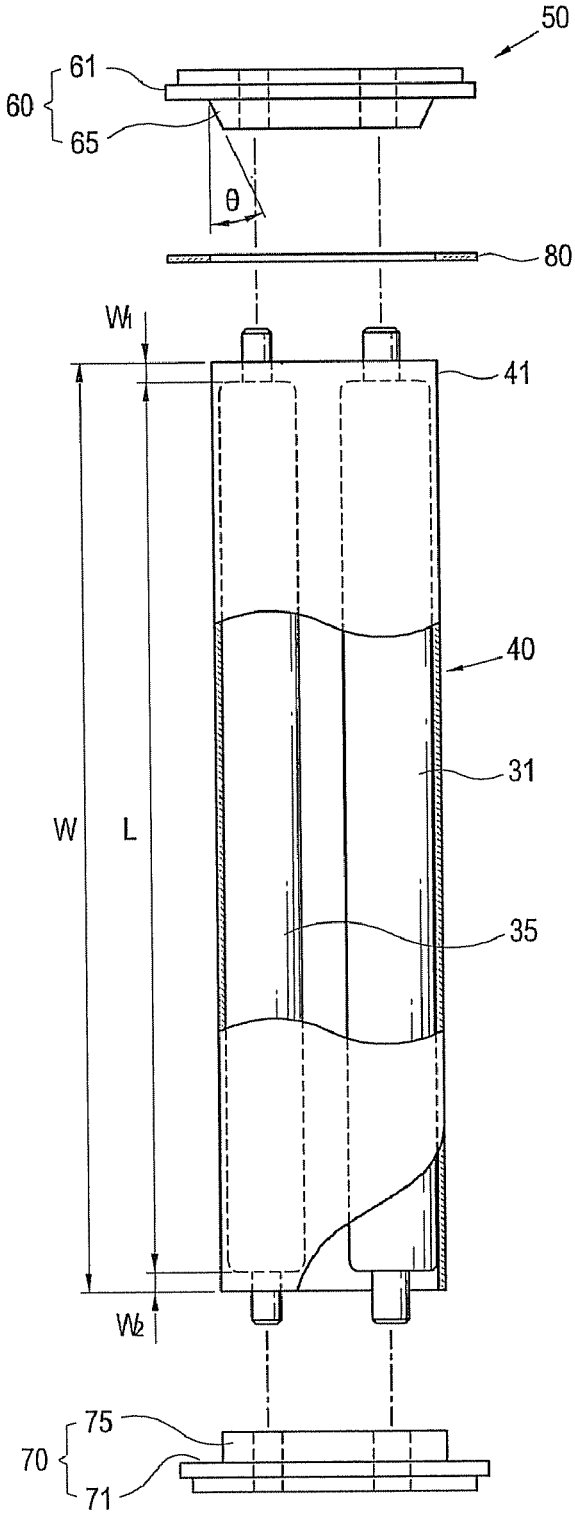
FIG. 5 is a disassembled plan view of the fusing unit according to an example embodiment of the present invention.

The fusing pressing belt 40, which is rotated by the first and the second pressing rollers 31 and 35, forms the fusing nip $N_2$ by contacting with the heating roller 25 or the supplied printable medium 10 at a part 40*a*. As shown in FIG. 4 and FIG. 5, a width W of the fusing pressing belt 40 may be larger than a length L of each of the first and the second pressing rollers 31 and 35 so that the heating roller 25 does not contact the first and the second pressing rollers 31 and 35 directly. Both end parts 41 in the width direction of the fusing pressing belt 40 protrude by predetermined widths $W_1$ and $W_2$ in the lengthwise direction of the first and the second pressing rollers 31 and 35 respectively.

Since the shape of the pressing unit 33 is maintained, the shape of the fusing pressing belt 40 wound on an outer surface of the pressing unit 33 remains as it is at the parts corresponding to the protruded widths $W_1$ and $W_2$, in an area where the fusing nip $N_3$ is formed. The shape of the fusing pressing belt 40 is therefore not deformed in the area where the fusing nip $N_3$ is formed and the fusing pressing belt 40 wound on the first and the second pressing rollers 31 and 35 is not loosened. As both end parts 41 of the fusing pressing belt 40, which protrude in the lengthwise direction of the first and the second pressing rollers 31 and 35, are not wrinkled or folded even at the area where the fusing nip $N_3$ is located, damage due to wrinkling or folding thereof can be avoided.

With regard to the direction in which the printable medium 10 is supplied, the printable medium 10 may be supplied so that a surface of the printable medium, on which the transferred but not fused toner image 15 is formed, faces the heating roller 25. As the heated outer surface of the heating roller 25 contacts the toner image 15 directly, fusing efficiency may be increased. In addition, contamination of the fusing pressing belt 40 by removal of the image due to an incomplete fusion may be prevented.

Figure 6:
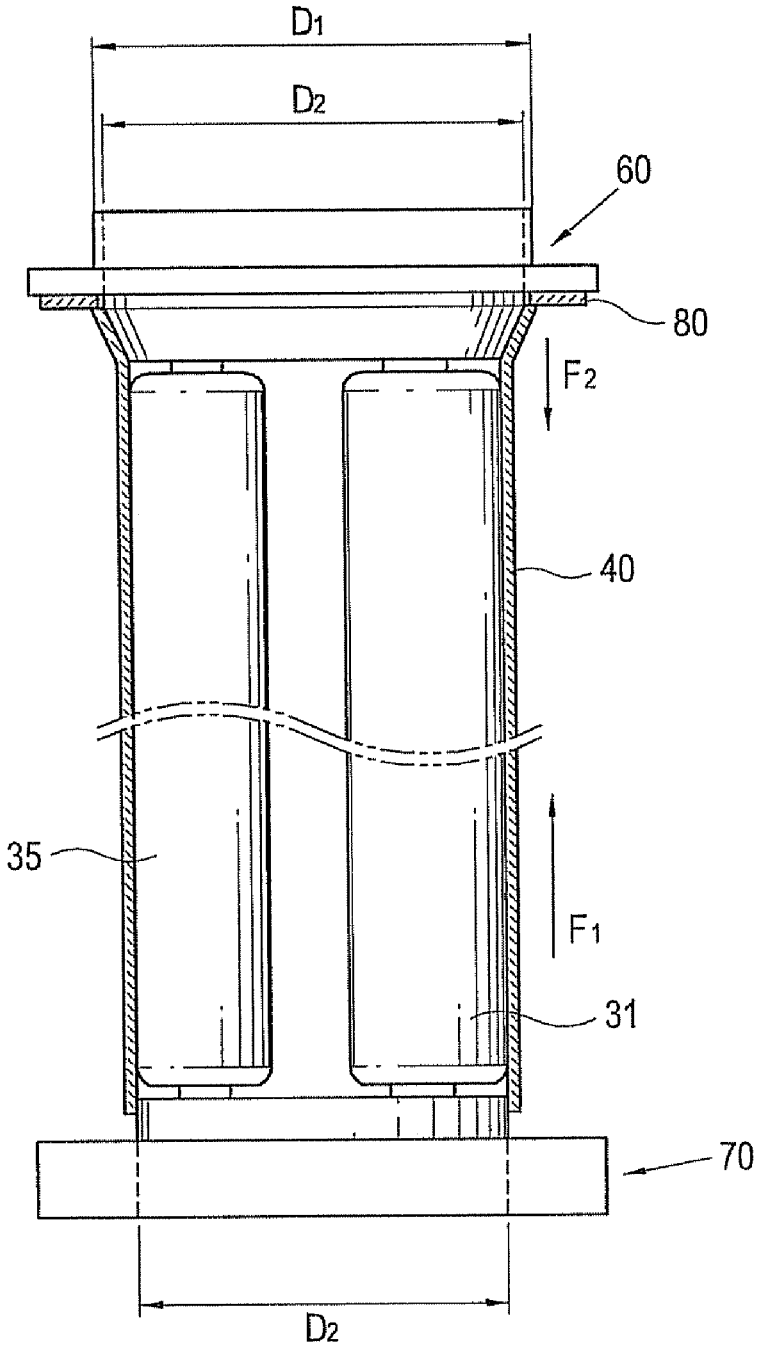
FIG. 6 is a plan view showing the fusing unit according to an example embodiment of the present invention.

As shown in FIG. 5 and FIG. 6, the supporting unit 50 rotatably supports the pressing rollers 31 and 35 and guides the fusing pressing belt 40. The supporting unit 50 comprises a first supporting member 60 and a second supporting member 70 provided at both end parts of the pressing rollers 31 and 35, respectively. The first supporting member 60 comprises a first restriction unit 61 and a first contacting unit 65. The second supporting member 70 comprises a second restriction unit 71 and a second contacting unit 75.

The first and the second restriction parts 61 and 71 restrict the movement of the fusing pressing belt 40 in an axial direction of the first and the second pressing rollers 31 and 35. The first and the second contacting parts 65 and 75 extend from the first and the second restriction unit 61 and 71, respectively, toward the fusing pressing belt 40, and contact an inner plate surface of the fusing pressing belt 40.

The first contacting unit 65 is formed to be inclined so that the shape of the first contacting unit 65 may become gradually smaller from the first restriction unit 61 to the protruded end part of the first contacting unit 65. The first contacting unit 65 may have the appearance of a truncated cone. An inclination angle θ of the first contacting unit 65 may satisfy the condition of Equation 2.

$$0° < \theta \leqq 10° \quad \text{(Equation 2)}$$

The lower limit value of Equation 2 is the minimum condition for the first contacting unit 65 to be formed to be inclined. If the upper limit value is exceeded, bending is increased at an inclination start position of the fusing pressing belt 40 that is wound on the first contacting unit 65, and the fusing pressing belt 40 may be damaged. As a bias force $F_2$ according to the inclination increases as described below, the fusing pressing belt 40 may be biasing against a desired bias toward the first contacting unit 65. The inclination angle θ may be equal to or less than 3° considering that the inclination angle θ exceeds the upper limit value.

The second contacting unit 75 is formed so that a surface of the second contacting unit 75 in contact with the fusing pressing belt 40 can be perpendicular to a restriction surface of the first restriction unit 71.

A major diameter $D_1$ of the first contacting unit 65 and a major diameter $D_2$ of the second contacting unit 75 may satisfy Equation 3 as follows.

$$D_1 > D_2 \quad \text{(Equation 3)}$$

If the major diameter $D_1$ of the first contacting unit 65 is larger than the major diameter $D_2$ of the second contacting unit 75, the fusing pressing belt 40, while rotating, receives a force in a direction of an arrow $F_1$ in FIG. 7. As the first contacting unit 65 is formed to be inclined on a condition that Equation 2 is satisfied, the biasing force $F_2$ according to the inclination acts in a direction opposite to that of $F_1$. Of the opposing biasing forces $F_1$ and $F_2$, $F_1$ is set to be relatively greater than $F_2$ in determining $D_1$, $D_2$, and the inclination angle θ. Therefore, the fusing pressing belt 40 biases toward the first supporting member 60 by a biasing force corresponding to a difference between the two biasing forces $F_1$ and $F_2$.

A wearing prevention plate 80 may be further provided between the first restriction unit 61 and the fusing pressing belt 40. The wearing prevention plate 80 may be inserted in the first contacting unit 65 and contacts a lateral surface of the fusing pressing belt 40, which biases toward the first supporting member 60, to guide the rotation of the fusing pressing belt 40. The wearing prevention plate 80 may be made of a material having a low coefficient of friction, so that damage to the fusing pressing belt 40, which contacts with the wearing prevention plate 80, may be prevented.

The wearing prevention plate 80 may be made of a conductive material having a high electric conductivity. The fusing pressing belt 40 may be continuously in contact with the wearing prevention plate 80 by the biasing force corresponding to the difference between $F_1$ and $F_2$ in order to be grounded. This may improve the electrical safety of the fusing pressing belt 40.

Figure 7A:
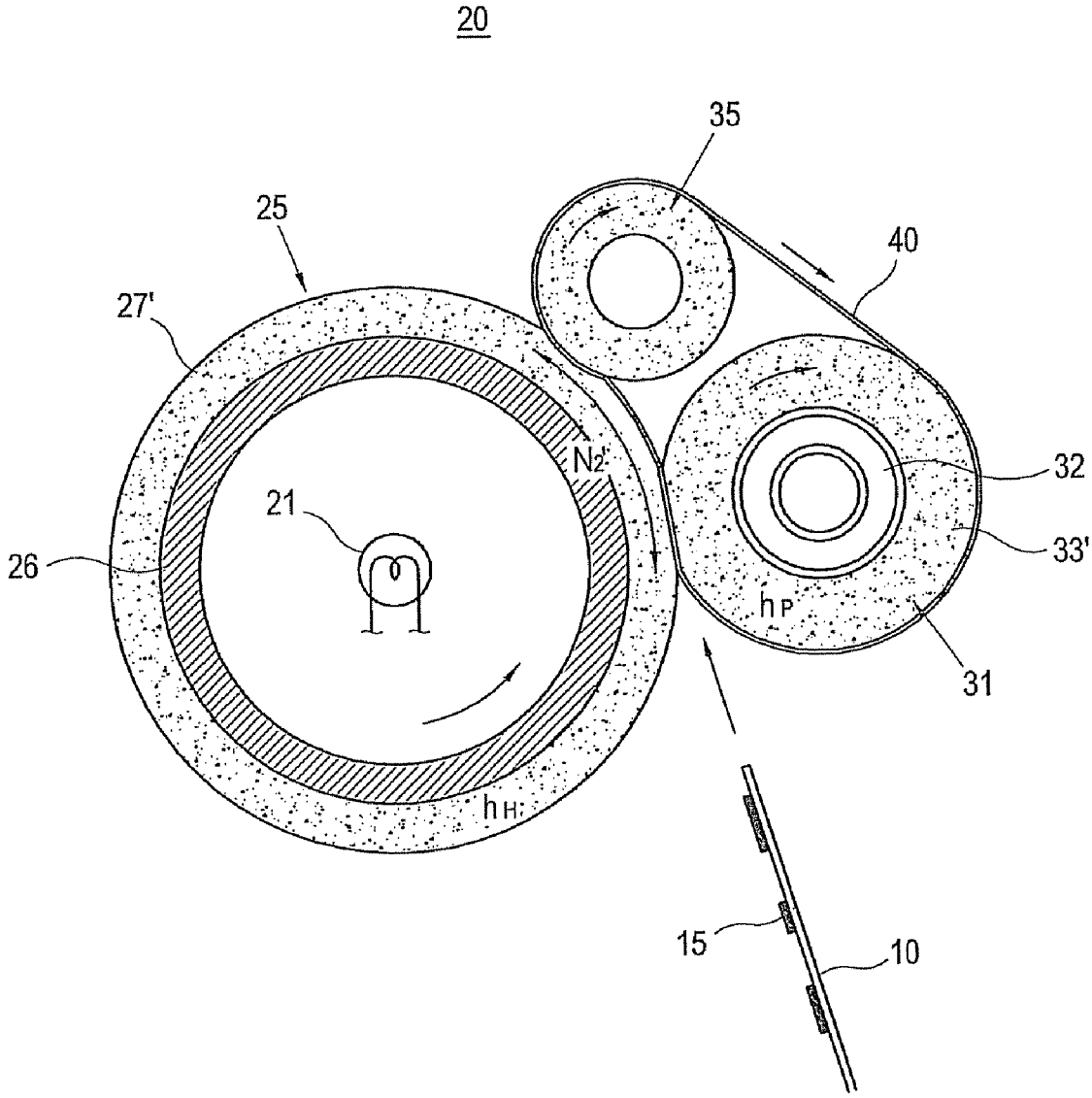
FIG. 7A is a schematic sectional view showing a fusing unit according to another example embodiment of the present invention.
Figure 7B:
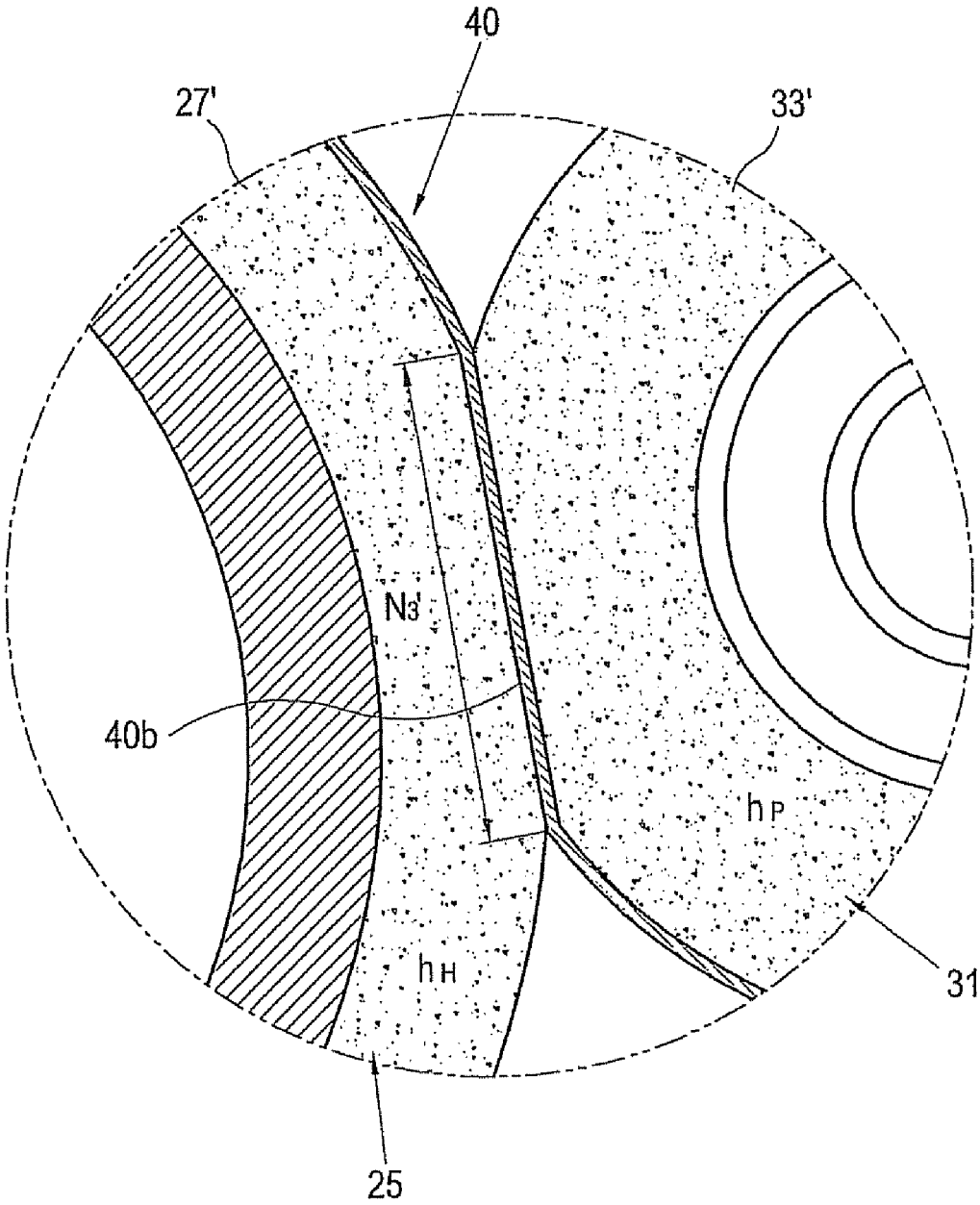
FIG. 7B is an expanded schematic sectional view partially showing the fusing unit in FIG. 7A.

FIG. 7A is a schematic sectional view showing a fusing unit according to another example embodiment of the present invention. FIG. 7B is an expanded schematic sectional view partially showing the fusing unit in FIG. 7A. As shown in FIG. 7A and FIG. 7B, the fusing unit 20 comprises a heat source 21, a heating roller 25, a plurality of pressing rollers 31 and 35, a fusing pressing roller 40, and a supporting unit 50 (shown in FIG. 6). According to the second example embodiment, a hardness $h_H$ of a heating unit 27' of the heating roller 25 is set to be substantially the same as a hardness $h_P$ of at least one of the plurality of the pressing rollers 31 and 35.

The plurality of the pressing rollers may comprise a first pressing roller 31 and a second pressing roller 35. The first pressing roller 31 is placed at an upstream position along a direction in which the supplied printable medium 10 advances. The second pressing roller 35 is placed at a downstream position relative to the first pressing roller 31. The first pressing roller 31 comprises a shaft 32 rotatably supported by the supporting unit 50 and a pressing unit 33' formed at a circumference of the shaft 32 with a predetermined thickness.

The fusing pressing belt 40, which is provided to be rotated by the first and the second pressing rollers 31 and 35, forms a fusing nip $N_2'$ by contacting the heating roller 25 or the supplied printable medium 10 at a part 40*b*. As the hardness of the heating unit 27' is the same as that of the pressing unit 33', a fusing nip $N_3'$, formed between the heating roller 25 and the first pressing roller 31, has a shape of a straight line. Since the fusing pressing belt 40 has the shape of a straight line in an area where the fusing nip $N_3'$ is formed, the fusing pressing belt 40 is prevented from loosening. Therefore, the problem that a conventional fusing pressing belt is damage due to wrinkling or folding can be avoided.

Components other than the components described in connection with FIG. 7A and FIG. 7B are substantially the same as those of the fusing unit 20 shown in FIG. 3A and FIG. 3B. The components that are substantially the same as those of the example embodiment shown in FIG. 3A and FIG. 3B are given the same reference numerals and detailed descriptions thereof are omitted.

Figure 8:
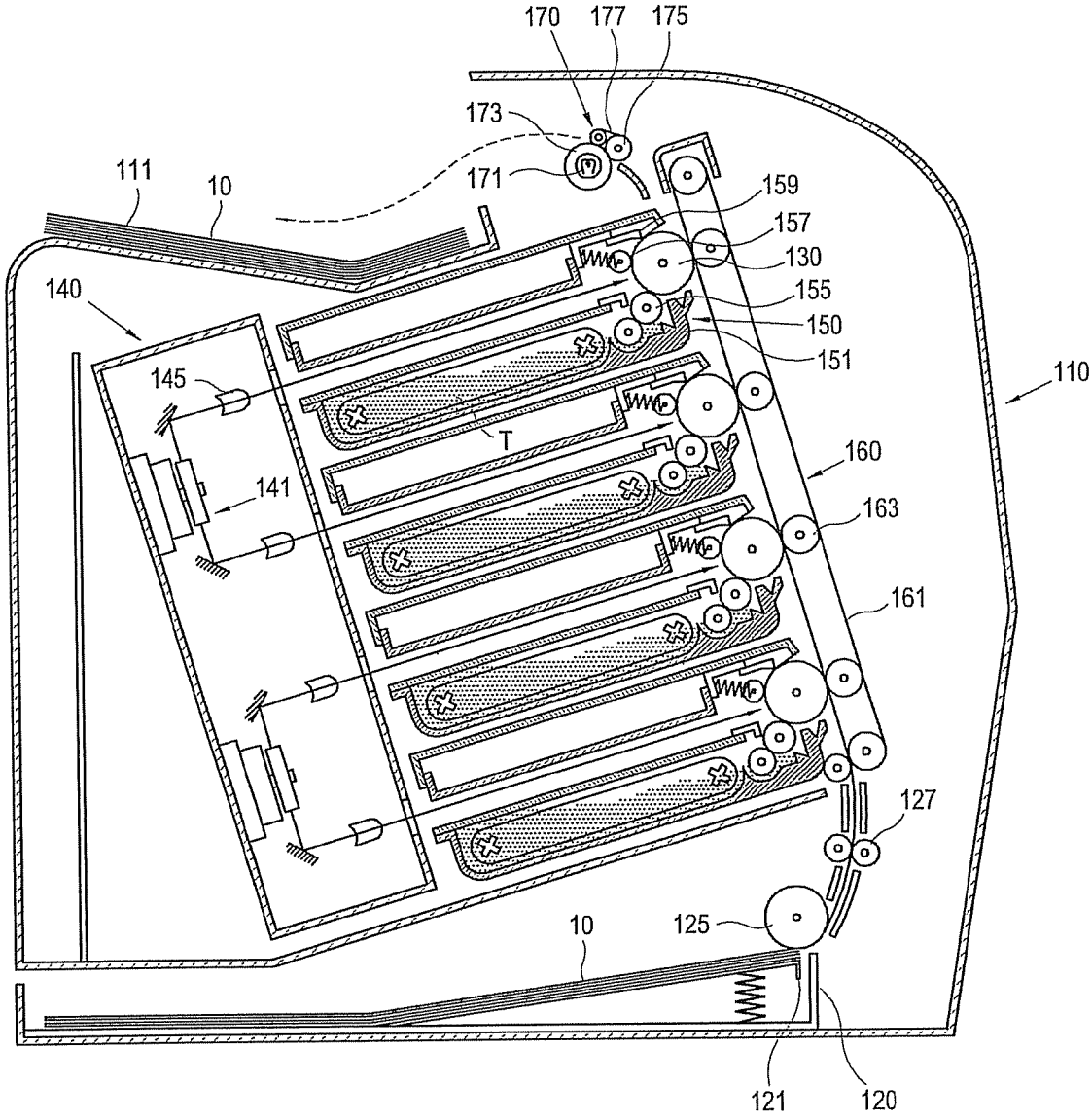
FIG. 8 is a schematic sectional view showing an image forming apparatus using the fusing unit according to an example embodiment of the present invention.

FIG. 8 is a schematic sectional view showing an image forming apparatus using the fusing unit according to an example embodiment of the present invention. According to this example embodiment, the image forming apparatus is a tandem type image forming apparatus and comprises a cabinet 110, a photosensitive medium 130 provided in the cabinet 110, a light scanning unit 140, a developing unit 150, a transfer unit 160 and a fusing unit 170. The image forming apparatus may contain other components as well; further, one or more of the above components may be combined into a single component.

The cabinet 110 forms an outer appearance of the image forming apparatus and has a discharging unit 111 at the outer surface to stack the discharged printable medium 10. A supplying unit 120 to load the printable medium 10 to be supplied is detachably provided in the cabinet 110. The printable medium 10, which is supplied by the supplying unit 120, is supplied through a conveying path toward the developing unit 150. The supplying unit 120 is provided in the cabinet 110. The supplying unit 120 picks up a sheet of the loaded printable medium 10 by rotation of a feeding roller 125, and supplies the picked-up printable medium 10 through a conveying roller 127.

The photosensitive medium 130 is provided in the developing unit 150. The photosensitive medium 130 responds to a beam scanned by the light scanning unit 140 to form an electrostatic latent image on the outer surface of the photosensitive medium 130. The developing unit 150 comprises a toner container 151 accommodating a toner T, a developing roller 155 placed opposite to the photosensitive medium 130 to develop the toner for an area of the photosensitive medium 130 where the electrostatic latent image is formed, a supplying roller 156 to supply the developing roller 155 with the toner T, and a charger 157 to charge the photosensitive medium 130 to a predetermined electric potential. A cleaning blade 159 may be further provided to remove a waste toner remaining on the photosensitive medium 130.

The developing unit 150 and the photosensitive medium 130 are provided for each color to form a full color image by a single path type. FIG. 8 shows an exemplary embodiment where four units are provided to realize colors of yellow Y, magenta M, cyan C and black K respectively.

The light scanning unit 140 scans a beam onto each of the plurality of photosensitive media 130 to form electrostatic latent images. The light scanning unit 140 has a multi-beam light scanning structure to scan beams onto a plurality of photosensitive media 130 simultaneously. The light scanning unit 140 comprises a light source (not shown), a beam deflector 141 to deflect and scan a beam applied by the light source, and an f-θ lens 145 to image the light deflected and scanned by the beam deflector 141 onto a scanning surface. The light source may have a structure where a plurality of emitting points is provided, or a structure where a plurality of semiconductors device having a single emitting point respectively is provided for each color. As shown in FIG. 8, the beam deflector 141 may comprise two rotating polygon mirrors. In this case, the rotating polygon mirrors deflect and scan two beams, which are applied by the light source, in different paths from each other.

The transfer unit 160 is positioned opposite the photosensitive medium 130 to have the printable medium 10 conveyed through the conveying path between the transfer unit 160 and the photosensitive medium 130. The transfer unit 160 transfers the toner image 15 formed on the photosensitive medium 130 onto the supplied printable medium 10. The transfer unit 160 comprises a transfer belt 161 and a transfer backup roller 163 that are positioned opposite the plurality of photosensitive media 130. The image that has been transferred onto the printable medium 10 by the transfer unit 160 is fused by the fusing unit 170.

The fusing unit 170 comprises a heat source 171, a heating roller 173, a plurality of pressing rollers 175, and a fusing pressing belt 177. The surface of the heating roller 173 is heated by the heat source 171. The toner image 15 transferred onto the printable medium 10 is fused by pressure between the pressing roller 175 and the fusing pressing belt 177.

The structure and an operation of the fusing unit 170 are substantially the same as those of the fusing unit according to the first or the second embodiment of the present invention.

As described above, according to aspects of the present invention, deformation of the shape of the fusing pressing belt in the area where the fusing nip $N_3$ is formed can be reduced by making the pressing roller have a surface hardness equal to or greater than the surface hardness of the heating roller, so that wrinkling or folding of the fusing pressing belt may be reduced. Damage due to wrinkling or folding can therefore be avoided.

The belt bias of the fusing pressing belt is guided in one direction and the friction preventing structure is provided in the direction of the belt bias of the fusing pressing belt, so that damage to the fusing pressing belt can be prevented.

According to aspects of the present invention, a uniform fusibility can be obtained using the fusing unit described above, so that printing quality can be enhanced. Especially, if the fusing unit according to aspects of the present invention is used in the electrophotographic image forming apparatus of the tandem type where a wide fusing nip is required compared to a monochromatic electrophotographic image forming apparatus, fusion stability may be highly enhanced.

Although a few embodiments of the present invention have been shown and described, it will be appreciated by those skilled in the art that changes may be made in this embodiment without departing from the principles and spirit of the invention, the scope of which is defined in the claims and their equivalents.

What is claimed is:

1. A fusing unit provided in a printing path of an image forming apparatus to fuse an image transferred onto a printable medium, the fusing unit comprising:

a heating roller;

a plurality of pressing rollers provided opposite the heating roller to press a printable medium in cooperation with the heating roller, the plurality of pressing rollers comprising a first pressing roller to be placed at an upstream position along a direction in which the printable medium advances and a second pressing roller to be placed at a downstream position relative to the first pressing roller; and a fusing pressing belt wound on the plurality of pressing rollers to form a fusing nip when in contact with the heating roller, the fusing nip fusing the image onto the printable medium;

wherein a surface hardness of the first pressing roller is greater than or equal to a surface hardness of the heating roller.

2. The fusing unit according to claim 1, wherein the printable medium is supplied in a direction in which a surface of the printable medium, on which a toner image transferred but not yet fused is formed, faces the heating roller.

3. The fusing unit according to claim 1, wherein the fusing nip formed between the heating roller and the fusing pressing belt has a shape of the first pressing roller or of a straight line.

4. The fusing unit according to claim 1, further comprising a supporting unit rotatably supporting the plurality of pressing rollers and guiding the fusing pressing belt, wherein the supporting unit comprises a contacting unit to contact with an inner plate surface of the fusing pressing belt when the supporting unit is coupled with the fusing pressing belt.

5. A fusing unit provided in a printing path of an image forming apparatus to fuse an image transferred onto a printable medium, the fusing unit comprising:

a heating roller;

a plurality of pressing rollers provided opposite the heating roller to press a printable medium in cooperation with the heating roller and;

a fusing pressing belt wound on the plurality of pressing rollers to form a fusing nip when in contact with the heating roller, the fusing nip fusing the image onto the printable medium;

wherein a surface hardness $h_P$ of at least one of the plurality of pressing rollers is greater than or equal to a surface hardness $h_H$ of the heating roller, and wherein a width of the fusing pressing belt is relatively larger than a length of the plurality of pressing rollers.

6. The fusing unit according to claim 5, further comprising a supporting unit rotatably supporting the plurality of pressing rollers to guide the fusing pressing belt, wherein the supporting unit comprises:

a first supporting member comprising a first restriction unit to restrict a movement of the fusing pressing belt in an axial direction of the first or second pressing roller and a first contacting unit protruding from the first restriction unit toward the fusing pressing belt to contact with an inner plate surface of the fusing pressing belt; and a second supporting member comprising a second restriction unit to restrict the movement of the fusing pressing belt in the axial direction of the first or second pressing roller and a second contacting unit protruding from the second restriction unit toward the fusing pressing belt to contact with the inner plate surface of the fusing pressing belt.

7. The fusing unit according to claim 6, wherein:

the first contacting unit is formed to be inclined so that the shape of the first contacting unit becomes smaller gradually from the first restriction unit to the protruded end; and the second contacting unit is formed so that a surface of the second contacting unit contacting the fusing pressing belt is perpendicular to a restriction surface of the second restriction unit.

8. The fusing unit according to claim 7, wherein an inclination angle of the first contacting unit is more than 0° and equal to or less than 10°.

9. The fusing unit according to claim 7, wherein a major diameter $D_1$ of the first contacting unit is greater than a major diameter $D_2$ of the second contacting unit, so that the fusing pressing belt biases toward the first supporting member while the fusing pressing belt is rotating.

10. The fusing unit according to claim 9, further comprising a wearing prevention plate, inserted in the first contacting unit and provided between the first restriction unit and the fusing pressing belt, to guide the rotation of the fusing pressing belt and to prevent wearing of the fusing pressing belt.

11. The fusing unit according to claim 10, wherein the wearing prevention plate comprises a conductive material.

12. An image forming apparatus comprising:

a photosensitive medium;

a developing unit to develop a supplied toner to form an image;

a light scanning apparatus to scan a light onto the photosensitive medium to form an electrostatic latent image;

a transfer unit provided opposite the developing unit to transfer the image formed by the developing unit onto a printable medium;

a fusing unit to fuse a toner image transferred onto the printable medium, the fusing unit comprising a heating roller, a plurality of pressing rollers provided opposite the heating roller to press a printable medium in cooperation with the heating roller, and a fusing pressing belt wound on the plurality of pressing rollers to form a fusing nip when in contact with the heating roller, wherein a surface hardness $h_P$ of at least one of the plurality of pressing rollers is greater than or equal to a surface hardness $h_H$ of the heating roller; and a supporting unit rotatably supporting the plurality of pressing rollers to guide the fusing pressing belt, the supporting unit comprises:

a first supporting member comprising a first restriction unit to restrict a movement of the fusing pressing belt in an axial direction of the pressing rollers and a first contacting unit protruding from the first restriction unit toward the fusing pressing belt to contact with an inner plate surface of the fusing pressing belt; and a second supporting member comprising a second restriction unit to restrict the movement of the fusing pressing belt in the axial direction of the pressing rollers and a second contacting unit protruding from the second restriction unit toward the fusing pressing belt to contact with the inner plate surface of the fusing pressing belt.

13. The image forming apparatus according to claim 12, wherein the fusing nip formed between the heating roller and the fusing pressing belt has a shape of the pressing roller or of a straight line.

14. The image forming apparatus according to claim 12, wherein a major diameter $D_1$ of the first contacting unit is greater than a major diameter $D_2$ of the second contacting unit, so that the fusing pressing belt biases toward the first supporting member while the fusing pressing belt is rotating.

15. The image forming apparatus according to claim 14, further comprising a wearing prevention plate, inserted in the first contacting unit and provided between the first restriction unit and the fusing pressing belt, to guide the rotation of the fusing pressing belt and to prevent wearing of the fusing pressing belt.

16. A fusing unit comprising:

a heating roller heated by a heat source;

a plurality of pressing rollers arranged opposite to, and pressed against, the heating roller; and a fusing pressing belt wound around the plurality of pressing rollers and arranged such that a portion of the fusing pressing belt protruding beyond the pressing rollers is not wrinkled or deformed;

wherein toner on a printable medium is fused to the printable medium as the printable medium passes between the fusing pressing belt and the heating roller.

17. The fusing unit according to claim 16, wherein a fusing nip formed between the heating roller and the fusing pressing belt is in the shape of the pressing roller or in the shape of a straight line.

18. The fusing unit according to claim 16, wherein the hardness of a surface of at least one of the plurality of pressing rollers is greater than or equal to the hardness of a surface of the heating roller.

19. The fusing unit according to claim 16, further comprising a supporting unit rotatably supporting the plurality of pressing rollers and guiding the fusing pressing belt.

20. The fusing unit according to claim 19, wherein the supporting unit comprises a contacting unit to contact with an inner plate surface of the fusing pressing belt when the supporting unit is coupled with the fusing pressing belt.

* * * * *